US007210213B2

(12) United States Patent
Miyamoto et al.

(10) Patent No.: US 7,210,213 B2
(45) Date of Patent: May 1, 2007

(54) METHOD FOR MANUFACTURING A DYNAMIC SPEAKER

(75) Inventors: Kazumi Miyamoto, Yamanashi (JP); Naoki Miura, Yamanashi (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 463 days.

(21) Appl. No.: 10/900,225

(22) Filed: Jul. 28, 2004

(65) Prior Publication Data

US 2005/0022366 A1 Feb. 3, 2005

(30) Foreign Application Priority Data

Jul. 29, 2003 (JP) ..... 2003-202861

(51) Int. Cl.
*H04R 31/00* (2006.01)

(52) U.S. Cl. ..... 29/594; 29/592.1; 29/609.1; 228/181; 228/190; 264/212; 264/216; 264/320; 264/323; 381/113; 381/116; 381/182; 381/186; 381/191

(58) Field of Classification Search ..... 29/592.1, 29/594, 609.1; 381/113, 116, 191, 174, 182, 381/186; 228/181, 190; 264/212, 216, 320, 264/323, 331.12
See application file for complete search history.

(56) References Cited

U.S. PATENT DOCUMENTS 5,283,027 A * 2/1994 Sakamoto et al. ..... 264/320
5,875,253 A * 2/1999 Okazaki et al. ..... 381/396
6,714,656 B1 * 3/2004 Coffin ..... 381/420

FOREIGN PATENT DOCUMENTS

JP 09084185 A * 3/1997
JP 2001-176586 6/2001

OTHER PUBLICATIONS

"Dynamic speaker adaptation for feature-based isolated word recognition"; Stern, R.; Lasry, M.; Acoustics, Speech, and Signal Processing [see also IEEE Transactions on Signal Processing], IEEE Transactions on vol. 35, Issue 6; Jun. 1987; pp. 751-763.*

* cited by examiner

*Primary Examiner*—Paul D. Kim
(74) *Attorney, Agent, or Firm*—Browdy and Neimark, PLLC

(57) ABSTRACT

A speaker collective substrate with component insertion hole sections and electrode sections has a plurality of speaker forming areas. An electrical speaker section, which comprises a magnetic circuit section and a vibration section, is inserted into each of the component insertion hole sections. Then, a collective lid, in which a plurality of lids have been formed for sealing the electrical speaker sections, is attached onto the speaker collective substrate. After that, the speaker collective substrate and the collective lid are divided into individual speaker forming areas along partition lines extending in the directions of the X and Y axes to form individual dynamic speakers. Thus, it is possible to mass-produce dynamic speakers with uniform quality through a collectively manufacturing process.

3 Claims, 8 Drawing Sheets

METHOD FOR MANUFACTURING A DYNAMIC SPEAKER

CROSS REFERENCE TO RELATED APPLICATION

The application claims the priority benefit of Japanese Patent Application No. 2003-202861, filed on Jul. 29, 2003, the entire descriptions of which are incorporated herein by reference.

BACKGROUND OF THE INVENTION

1. Field of the Invention

The present invention relates to a method for manufacturing a small dynamic speaker which can be installed in a cellular telephone, a personal digital assistant, and the like.

2. Description of the Related Art

Conventionally, a small dynamic speaker which can be installed in a cellular phone, a personal digital assistant and the like is disclosed in, for example, Japanese Patent Laid-Open Publication No. 2001-176586. In this dynamic speaker 1, as shown in FIGS. 7 and 8, an electrical speaker section 11 which comprises magnetic members, that is, a yoke 3, a magnet 4, a plate 5, a coil 6, and a diaphragm 7 are mounted on a frame 2, while a lid 8 with sound emission holes 8*a* covers the electrical speaker section 11 from above. A connection substrate 9 is provided in a part of the bottom face of the frame 2, so that the electrical speaker section 11 is electrically connected to a substrate of equipment (not illustrated) via the connection substrate 9.

When the foregoing dynamic speaker 1 is manufactured, the frame 2 is appropriately formed in advance to the shape and size of the electrical speaker section 11. Then, the electrical speaker section 11 and the lid 8 are successively mounted on the frame 2. Next the connection substrate 9 for installing the dynamic speaker 1 in an equipment, such as a cellular phone, is attached to the bottom face of the frame 2.

Hence, in a conventional method for manufacturing the dynamic speaker 1, it is necessary to mount the electrical speaker section 11 on a frame 2 basis. Thus, it is difficult to mass-produce dynamic speakers 1 with uniform quality in a single process. Also, a process for attaching the connection substrate 9 to the frame 2 is required to install the dynamic speaker 1 in the substrate of equipment such as a cellular telephone. Therefore, there are problems in that the conventional method needs a large number of steps in a manufacturing process, and has a high cost.

SUMMARY OF THE INVENTION

The present invention aims to solve the problems described above. An object of the present invention is to provide a method for manufacturing a dynamic speaker which can mass-produce the dynamic speakers with uniform quality through a collectively manufacturing process while reducing the number of steps in the manufacturing process, and cost.

To achieve the foregoing object, a method for manufacturing a dynamic speaker according to the present invention comprises the steps of: setting electrical speaker sections into component insertion holes formed in a speaker collective substrate; attaching a collective lid on the speaker collective substrate; and dividing the speaker collective substrate and the collective lid. The speaker collective substrate has the component insertion hole sections and electrode sections. The speaker collective substrate also has a plurality of speaker forming areas. The electrical speaker section comprises a magnetic circuit section having a yoke, a magnet, and a plate, and a vibration section having a coil and a diaphragm. A plurality of lids used for sealing the electrical speaker sections are formed in the collective lid. After the collective lid is attached, the speaker collective substrate and the collective lid are divided along the speaker forming areas to form the individual dynamic speakers.

According to the present invention, the plurality of electrical speaker sections, each of which comprises the magnetic circuit section and the vibration section, are firstly disposed on the speaker collective substrate. Then the collective lid covers the top of the speaker collective substrate. After that, the speaker collective substrate and the collective lid are divided along the speaker forming areas, so that it is possible to mass-produce the dynamic speakers with uniform quality through a collectively manufacturing process.

Another method for manufacturing a dynamic speaker according to the present invention comprises a speaker collective substrate forming step, and a collective lid attachment step. In the speaker collective substrate forming step, a through-hole electrode is provided in a corner of each of a plurality of speaker forming areas, which are partitioned by an X axis and a Y axis into a quadrilateral shape in a speaker collective substrate. Also, a component insertion hole section is formed in approximately the center of the speaker forming area. In the collective lid attachment step, an electrical speaker section comprising a yoke, a magnet, a plate, a coil, and a diaphragm is formed in each of the component insertion hole sections. Then, a collective lid with a sound emission hole is attached on the tops of the electrical speaker sections. After that, the speaker collective substrate and the collective lid are linearly diced along the X axis and the Y axis through the centers of the through-hole electrodes, to divide them into the individual dynamic speakers.

According to the invention, the quality of products from each step becomes uniform when the dynamic speakers are manufactured by the speaker collective substrate forming step and the collective lid attachment step. Production, including the number of steps and cost in each process, is precisely controlled so that it is possible to adjust production in detail in accordance with demand.

The collective lid may comprise a flat plate with a sound emission hole and a spacer for holding the flat plate at a predetermined height from the surface of the speaker collective substrate.

DETAILED DESCRIPTION OF THE PREFERRED EMBODIMENTS

A method for manufacturing a dynamic speaker according to the present invention will be hereinafter described in detail on the basis of the accompanying drawings.

Figure 1:
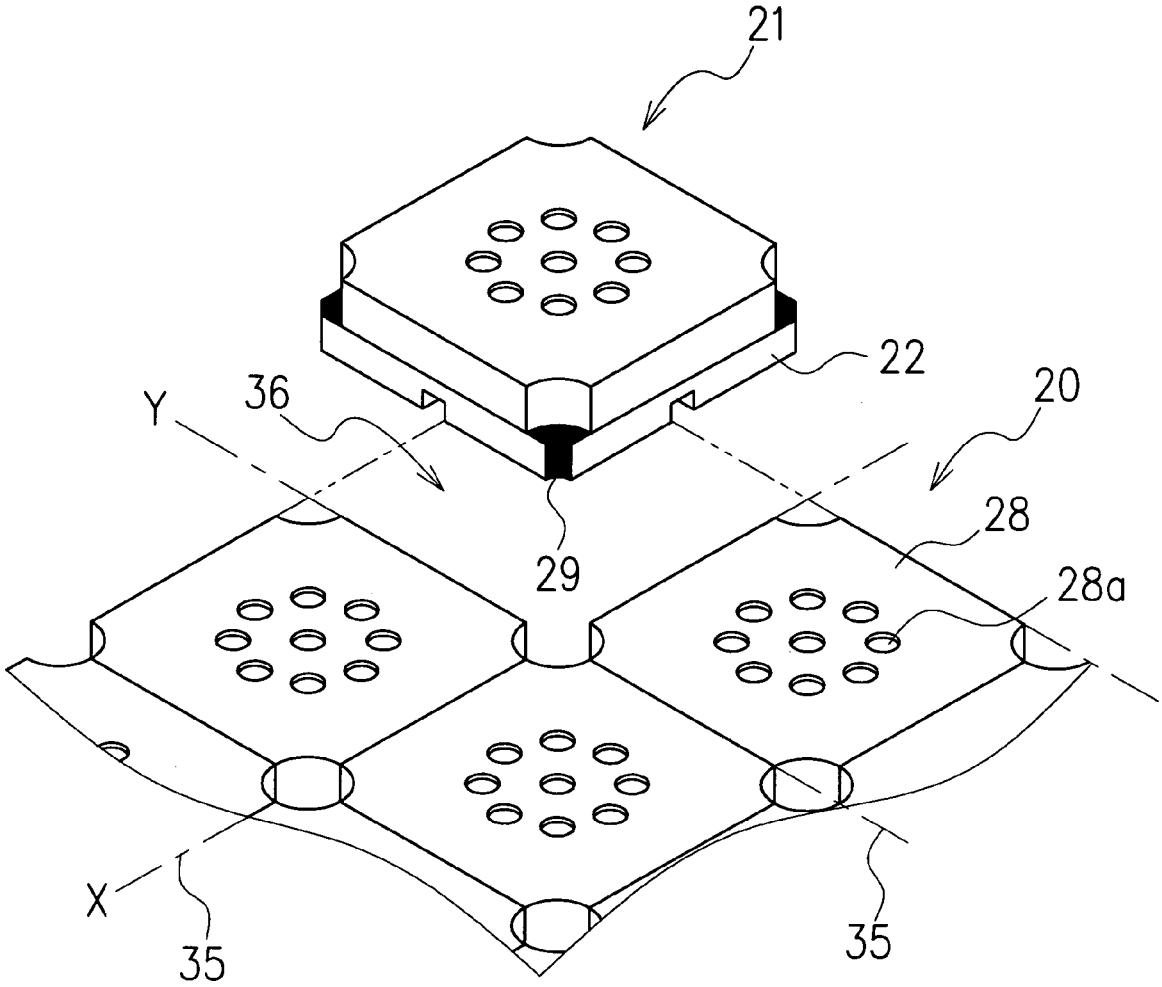
FIG. 1 is a perspective view of a speaker assemblage which is formed by a method for manufacturing a dynamic speaker according to the present invention.

FIG. 1 shows a speaker assemblage 20 in which a plurality of dynamic speakers 21 are formed on a speaker collective substrate 22. To form this speaker assemblage 20, electrical speaker sections 31, each of which comprises a magnetic circuit section 31*a* and a vibration section 31*b*, to be described later, are mounted on the speaker collective substrate 22 having a plurality of speaker forming areas. Then, a collective lid 28 with sound emission holes 28*a* formed therein is attached on the tops of the electrical speaker sections 31. The speaker assemblage 20 formed in this manner is diced along partition lines 35 in the directions of the X and Y axes, which are formed in the speaker collective substrate 22 and the collective lid 28, so that a plurality of individual dynamic speakers 21 are obtained.

Figure 2:
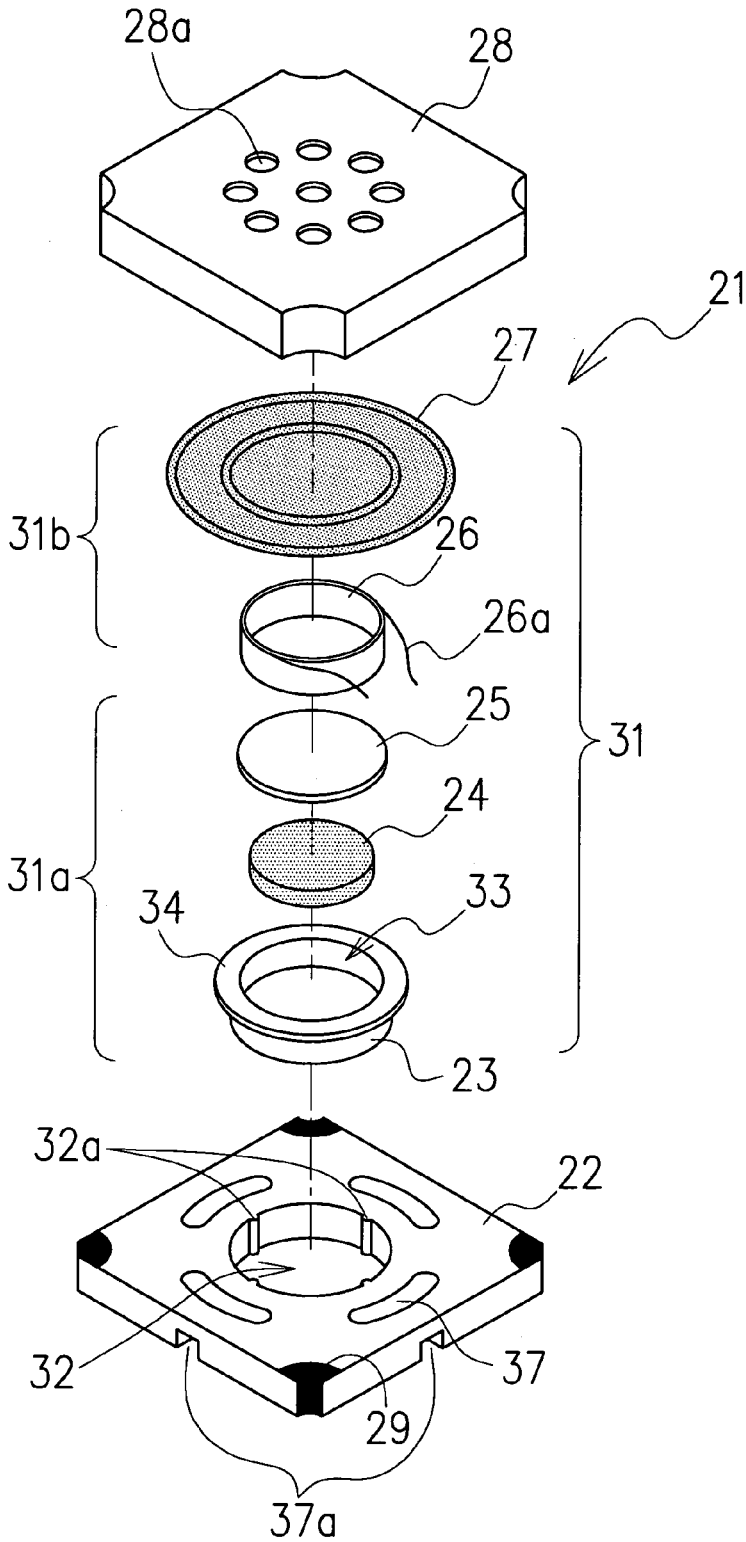
FIG. 2 is an exploded perspective view of a dynamic speaker formed in the speaker assemblage.

The speaker collective substrate 22 is made of glass epoxy, a BT resin (bismaleimide triazine resin) or the like, and formed into a quadrilateral shape. Through-hole electrode sections 29 are formed in four corners of each speaker forming area 36, and a wiring pattern is formed in the surface of the speaker forming area 36. A component insertion hole section 32, into which the electrical speaker section 31 is inserted and fixed, is formed in the center of the speaker forming area 36. The electrical speaker section 31, as shown in FIG. 2, comprises the magnetic circuit section 31*a* and the vibration section 31*b* which are combined with each other. The magnetic circuit section 31*a* has a magnet 24 and a plate 25, which are set in a metal yoke 23. The vibration section 31*b* comprises a coil 26 and a diaphragm 27. A cylindrical recessed portion 33 is provided inside the yoke 23, and a brim portion 34 extending outward is formed in the outer peripheral edge of the yoke 23. The brim portion 34 is mounted on and supported by the outer peripheral edge of the component insertion hole section 32. Since projections 32*a* are provided at predetermined points on the inner periphery of the component insertion hole section 32, it is possible to easily fix the electrical speaker sections 31 on the speaker collective substrate 22 to achieve stability. Long and narrow openings 37 are formed in the vicinity of the component insertion hole section 32 along the outer periphery thereof. The openings 37 dissipate and reduce a load due to the oscillation of the diaphragm 27 to the outside. It is preferable to form the plurality of openings 37 at regular intervals along the outer periphery of the component insertion hole section 32. Also, grooves 37*a* are provided from the openings 37 to the outer periphery of the speaker forming area 36, so that it is possible to further reduce the load due to the oscillation of the diaphragm 27.

The disk-shaped magnet 24 is fitted into the recessed portion 33, while a metal thin plate 25 made of the same material as the yoke 23 seals the top of the magnet 24. The coil 26 comprising a winding of a thin electric wire is disposed around the magnet 24. The thin diaphragm 27 is disposed on the top of the coil 26. When a predetermined voltage is applied to both ends of the coil 26, the diaphragm 27 vibrates with vibrational sound emitted to the outside through the sound emission holes 28*a* provided in the collective lid 28.

The electrode sections 29 are, as shown in FIGS. 1 and 2, from the top face along the side and to the bottom faces for each of the four corners of the speaker forming area 36. Lead portions 26*a* of the coil 26 within the electrical speaker section 31 are connected to the electrode sections 29.

Figure 3:
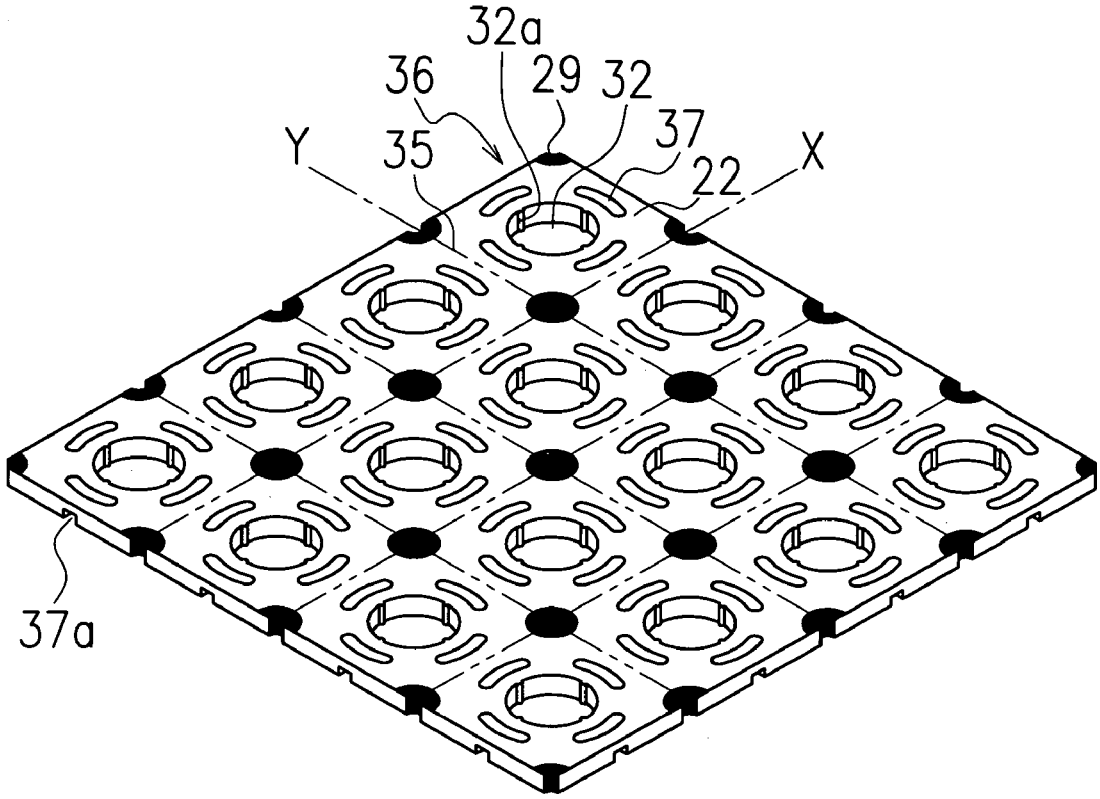
FIG. 3 is a perspective view of a speaker collective substrate which is a base of the speaker assemblage.

Next, a process for manufacturing the dynamic speaker 21 will be described on the basis of FIGS. 3 to 6. FIG. 3 shows the single speaker collective substrate 22 which is the base of the dynamic speakers 21 and is formed in a speaker collective substrate forming step. In this embodiment, the partition lines 35 for partitioning the speaker collective substrate 22 into the speaker forming areas 36 are provided in advance by printing or the like in the directions of the X axis and the Y axis. This is in such a manner that the illustrated sixteen electrical speaker sections 31 are formed per speaker collective substrate 22. The through-hole electrode sections 29 are formed in the four corners of each speaker forming area 36, as described above, and the component insertion hole section 32 for inserting the electrical speaker section 31 is formed in each center thereof. The projections 32*a* are formed at the predetermined points on the inner periphery of the component insertion hole section 32, for the purpose of facilitating the fixing of an electrical speaker section 31. The plurality of openings 37 are formed in the vicinity of the component insertion hole section 32. The grooves 37*a* are formed leading from the openings 37 to the outer periphery of the speaker forming area 36.

Figure 4:
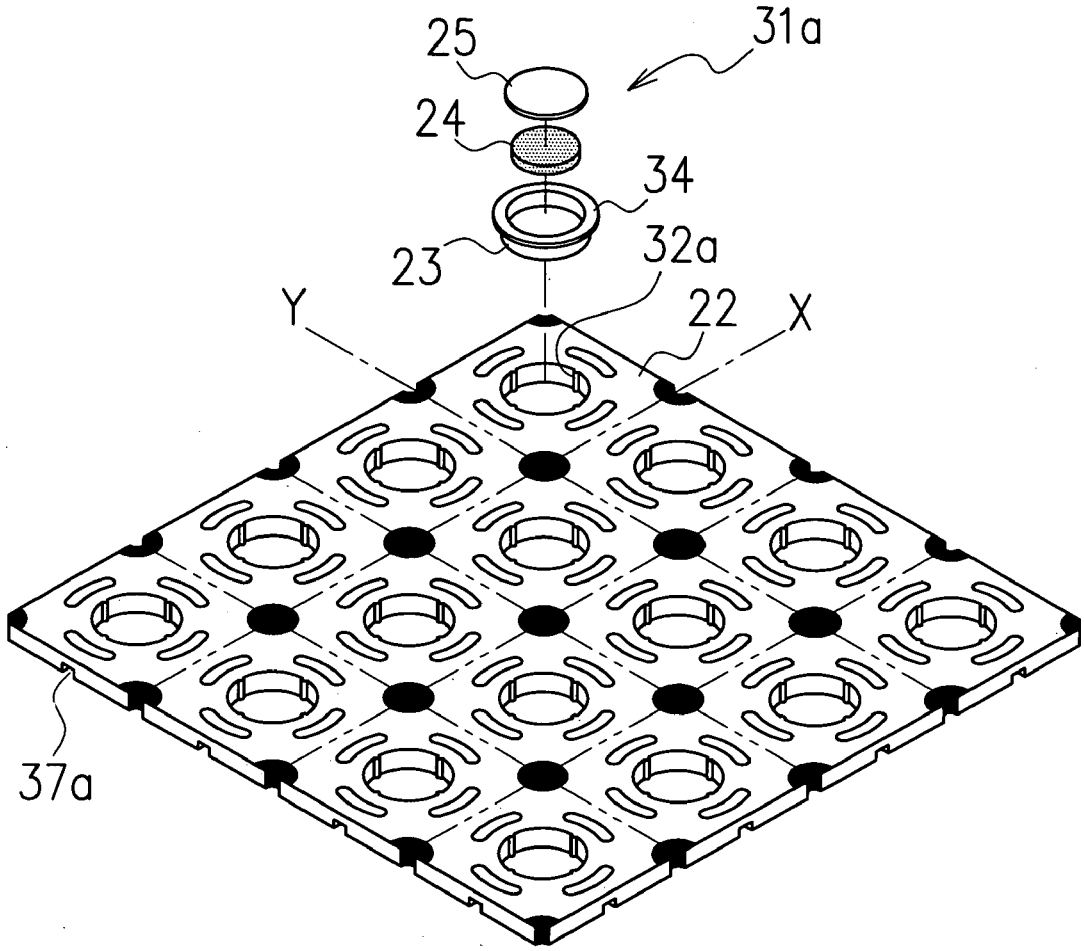
FIG. 4 is an explanatory view of a magnetic circuit forming step in which magnetic circuit sections are set in the speaker collective substrate.

FIG. 4 shows a magnetic circuit forming step. In the magnetic circuit forming step the yoke 23 of the magnetic circuit section 31*a*, which comprises the magnet 24 and the plate 25 fitted in the yoke 23, is inserted into the component insertion hole section 32. The yoke 23 is supported on the speaker collective substrate 22 with the brim portion 34. The thickness of the speaker collective substrate 22 is equal to or larger than the thickness of the lower portion of the yoke 23 (from the brim portion 34 to a bottom end) in which the electrical speaker section 31 is fitted. This is because when the speaker collective substrate 22 is mounted on a substrate of equipment (such as a motherboard), protrusion of the bottom of the yoke 23 onto the surface of the substrate of the equipment causes the installation to become unstable. Also, if the bottom of the yoke 23, which is made of metal, makes contact with the substrate of the equipment, it can cause a short.

Figure 5:
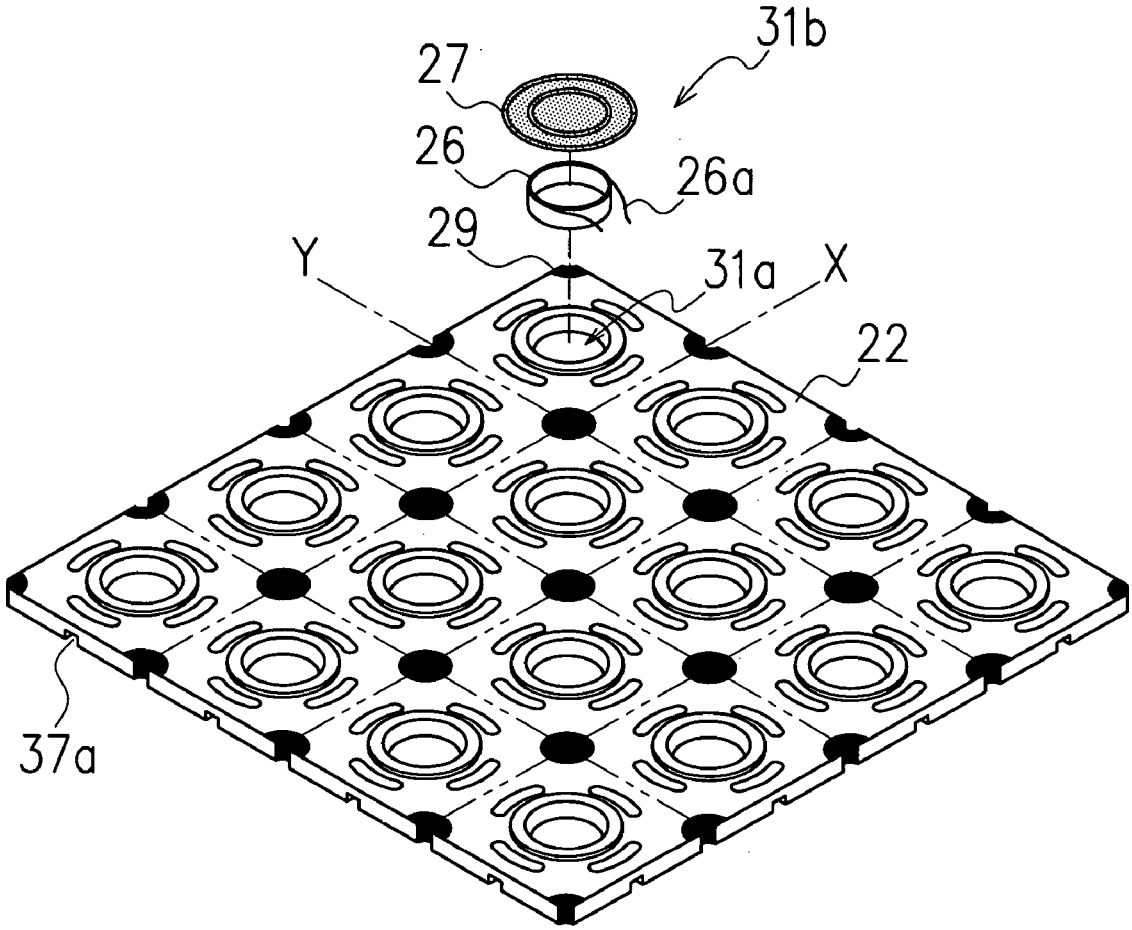
FIG. 5 is an explanatory view of a vibration section forming step in which vibration sections are set on the magnetic circuit sections.

FIG. 5 shows a vibration section forming step. In the vibration section forming step the vibration section 31*b*, which comprises the coil 26 and the diaphragm 27, is set onto the magnetic circuit section 31*a*. Then, the lead portions 26*a*, drawn out of the coil 26, are connected to the predetermined electrode sections 29 by soldering.

Figure 6:
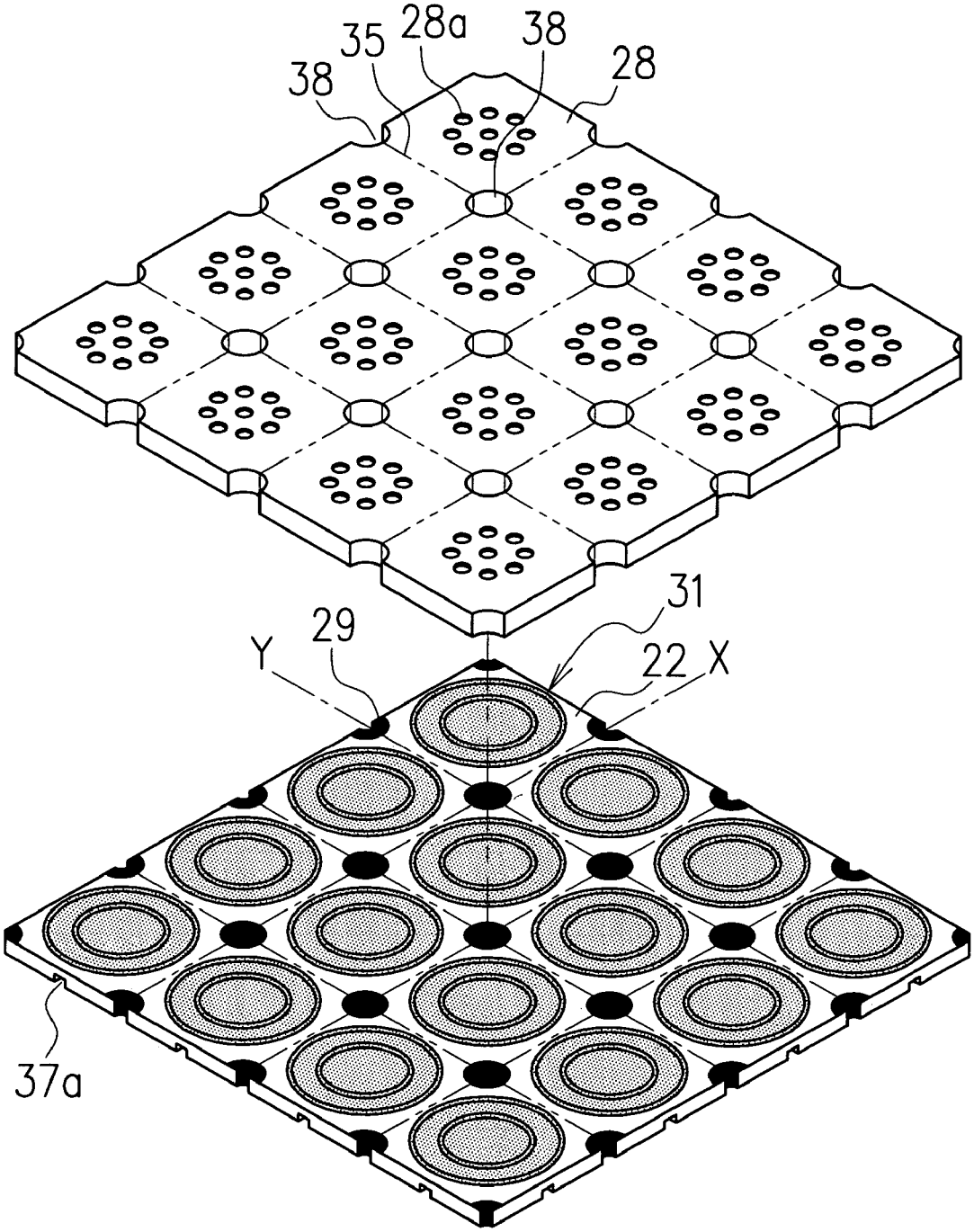
FIG. 6 is an explanatory view of a collective lid attachment step in which a collective lid is fitted on electrical speaker sections, each of which comprises the magnetic circuit section and the vibration section.
Figure 7:
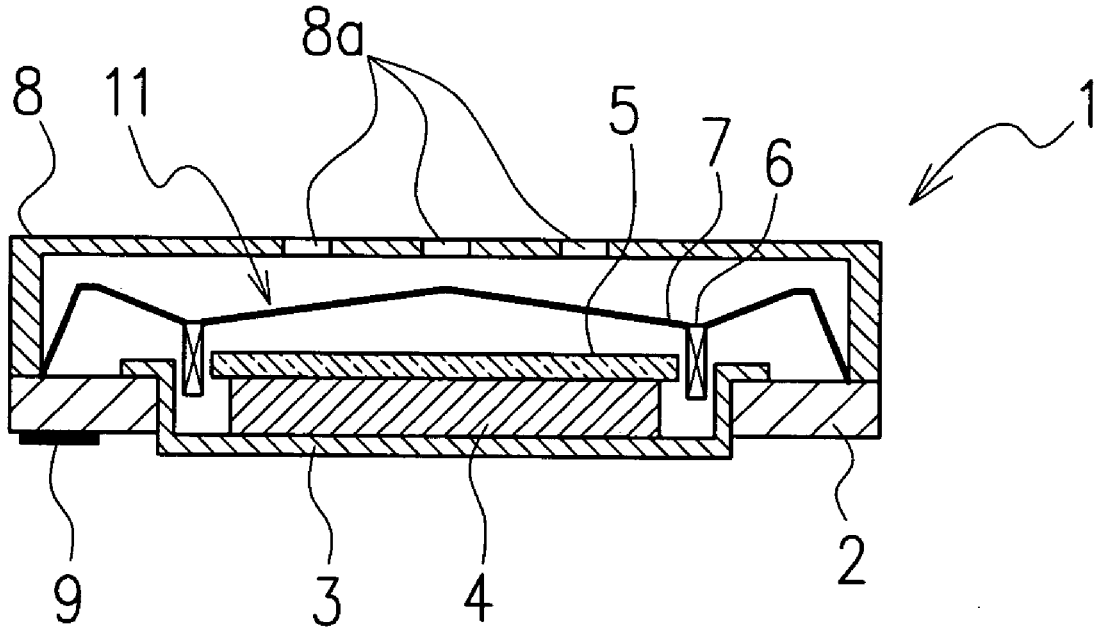
Fig. 7 (Prior Art)
FIG. 7 is a sectional view of a conventional dynamic speaker.
Figure 8:
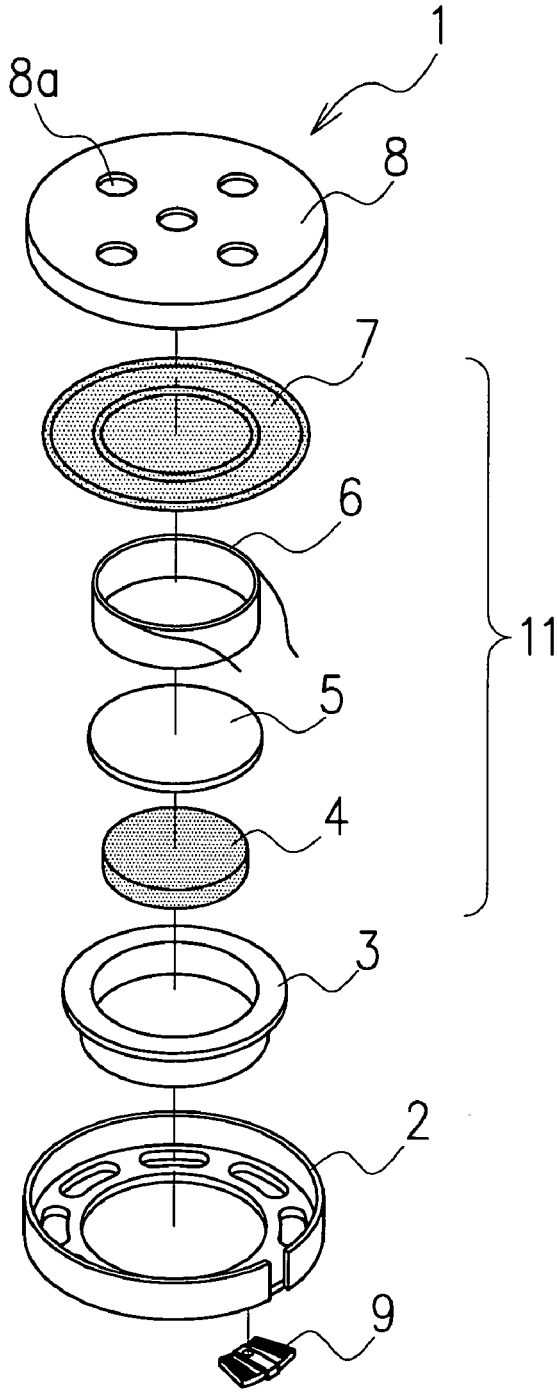
Fig. 8 (Prior Art)
FIG. 8 is an exploded perspective view of the conventional dynamic speaker.

FIG. 6 shows a collective lid attachment step. In the collective lid attachment step, the collective lid 28 is aligned on the tops of the electrical speaker sections 31, which have been installed in the speaker collective substrate 22. The collective lid 28 is then joined to the speaker collective substrate 22 with the use of an adhesive. As in the case of the speaker collective substrate 22, the collective lid 28 is provided with the partition lines 35 for partitioning the collective lid 28 into speaker forming areas. Additionally, holes 38 for exposing the electrode sections 29 of the speaker collective substrate 22 are formed in the collective lid 28.

The speaker assemblage 20 shown in FIG. 1 is formed by way of the foregoing steps, and the individual dynamic speakers 21 are formed by dicing the speaker assemblage 20 along the partition lines 35.

In the foregoing embodiment, the inside of the collective lid 28 is recessed so as to secure spaces for containing the electrical speaker sections 31, and acoustic spaces for reverberating sound. The collective lid, however, may be formed into the shape of a flat plate with sound emission holes. In this case, the collective lid may be disposed on the speaker collective substrate with a spacer interposed therebetween and having a height sufficient to secure predetermined acoustic spaces. According to this structure, open acoustic spaces exist between the speaker collective substrate and the collective lid, so that it is possible to reverberate sound emitted from the electrical speaker section 31 over a wide range.

Appropriate embodiments are described above, but the present invention is not limited to the embodiments.

What is claimed is:

1. A method for manufacturing a dynamic speaker comprising the steps of:

setting electrical speaker sections into component insertion holes formed in a speaker collective substrate, the speaker collective substrate having the component insertion holes, electrode sections, and a plurality of speaker forming areas, the electrical speaker sections each comprising a magnetic circuit section having a yoke, a magnet, and a plate, and a vibration section having a coil and a diaphragm;

attaching a collective lid, in which a plurality of lids for sealing the electrical speaker sections are formed, on the speaker collective substrate; and dividing the speaker collective substrate and the collective lid along the speaker forming areas to form a plurality of individual dynamic speakers.

2. A method for manufacturing a dynamic speaker comprising:

a speaker collective substrate forming step of providing a through-hole electrode in a corner of each of a plurality of speaker forming areas, which are partitioned by an X axis and a Y axis into a quadrilateral shape in a speaker collective substrate, and forming a component insertion hole section in an approximately center of the speaker forming area;

a collective lid attachment step of forming an electrical speaker section comprising a yoke, a magnet, a plate, a coil, and a diaphragm in each of the component insertion hole sections, and attaching a collective lid with a plurality of sound emission holes formed on the tops of the electrical speaker sections; and linearly dicing the speaker collective substrate and the collective lid along the X axis and the Y axis through the centers of the through-hole electrodes, to divide them into a plurality of individual dynamic speakers.

3. The method for manufacturing a dynamic speaker according to claim 2, wherein the collective lid comprises a flat plate with a sound emission hole and a spacer for holding the flat plate at a predetermined height from the surface of the speaker collective substrate.

* * * * *